US010683663B2

(12) United States Patent
Bolt

(10) Patent No.: US 10,683,663 B2
(45) Date of Patent: Jun. 16, 2020

(54) BUILDING SYSTEM AND MATERIAL

(71) Applicant: T3 BUILDING SOLUTIONS LIMITED, London (GB)

(72) Inventor: Dirk Bolt, Aberfeldy (GB)

(73) Assignee: T3 BUILDING SOLUTIONS LIMITED, London (GB)

( * ) Notice: Subject to any disclaimer, the term of this patent is extended or adjusted under 35 U.S.C. 154(b) by 0 days.

(21) Appl. No.: 15/757,872

(22) PCT Filed: Sep. 7, 2016

(86) PCT No.: PCT/GB2016/000162
§ 371 (c)(1),
(2) Date: Mar. 6, 2018

(87) PCT Pub. No.: WO2017/042525
PCT Pub. Date: Mar. 16, 2017

(65) Prior Publication Data

US 2018/0340330 A1 Nov. 29, 2018

(30) Foreign Application Priority Data

Sep. 7, 2015 (GB) ..... 1515774.6

(51) Int. Cl.

| | |
|---|---|
| ***E04B 2/02*** | (2006.01) |
| ***E04C 3/12*** | (2006.01) |
| ***E04B 1/10*** | (2006.01) |
| ***E04B 2/28*** | (2006.01) |

(52) U.S. Cl.
CPC ..... *E04B 2/02* (2013.01); *E04B 1/10* (2013.01); *E04B 2/28* (2013.01); *E04C 3/127* (2013.01)

(58) Field of Classification Search
CPC ..... E04B 1/10; E04B 2/70; E04B 2/28; E04B 2002/0282; E04B 2002/028; E04C 3/127; E04C 2002/3477; E04C 2002/3488
See application file for complete search history.

(56) References Cited

U.S. PATENT DOCUMENTS 2,129,441 A * 9/1938 Otto ..... E04B 1/10 52/236.7
5,228,249 A * 7/1993 Campbell ..... E02D 27/00 52/264

(Continued)

FOREIGN PATENT DOCUMENTS

EP 0250258 12/1987
EP 1522644 4/2005

(Continued)

*Primary Examiner* — Christine T Cajilig
(74) *Attorney, Agent, or Firm* — Duane Morris LLP; J. Rodman Steele, Jr.; Gregory M. Lefkowitz

(57) ABSTRACT

A sustainable building material and system comprising of panels with alternatively oriented spacers and with panel connectors, panel edges and composites thereof. It is manufactured from semi-material in two manufacturing operations; the first manufacturing the panels, panel connectors and edges and the second manufacturing sub-assembles or composite elements from these. The building material and system are suitable for manufacture and assembly at various levels of technology and investment, and are designed for efficiency in manufacture, transport and offsite and onsite assembly.

20 Claims, 4 Drawing Sheets

(56) References Cited

U.S. PATENT DOCUMENTS

| | | | | | |
|---|---|---|---|---|---|
| 5,618,371 | A * | 4/1997 | Sing | B27B 1/00 | 144/345 |
| 5,865,929 | A * | 2/1999 | Sing | B27B 1/00 | 144/345 |
| 6,446,412 | B2 * | 9/2002 | Mathis | B27M 3/0053 | 144/345 |
| 2005/0034408 | A1 * | 2/2005 | Palumbo | E04B 2/7457 | 52/633 |
| 2005/0241256 | A1 * | 11/2005 | Bolt | E04B 1/10 | 52/596 |
| 2016/0348368 | A1 * | 12/2016 | Godfrey | E04C 3/14 | |

FOREIGN PATENT DOCUMENTS

| | | | | | |
|---|---|---|---|---|---|
| EP | 2806078 | | 11/2014 | | |
| FR | 2550253 | A1 * | 2/1985 | E04B 1/10 | |
| GB | 2490304 | B * | 12/2016 | E04B 1/04 | |
| WO | WO-2009062215 | A2 * | 5/2009 | E04B 1/10 | |

* cited by examiner

BUILDING SYSTEM AND MATERIAL

CROSS-REFERENCE TO RELATED APPLICATIONS

This application is a § 371 national stage entry of International Application No. PCT/GB2016/000162, filed Sep. 7, 2016, which claims priority to Great Britain Patent Application No. GB1515774.6, filed Sep. 7, 2015, the entire contents of which are incorporated herein by reference.

INTRODUCTION

This invention relates to a building material and system and in particular, but not exclusively, to a building material and system for building houses and other domestic-scale structures.

BACKGROUND TO THE INVENTION

In the building industry there is a trend towards increasing competitiveness through investment in capital-intensive technology. However, this approach prevents the intended beneficiaries of housing policies to contribute their own abilities to the construction of their homes. Furthermore, the building industry faces economic and environmental issues such as waste, sustainability, energy, and the problems of small construction firms. Concerning the latter, a recent survey of small construction firms by the Feceration of Master Builders found that two-thirds of smaller firms had to turn down new business due to shortages in skilled workers, especially bricklayers, carpenters/joiners and plasterers. The issues call for the use of technology and automation in not only the manufacture of building material but also its transport and offsite/onsite assembly in a manner that maintains the option of labour participation by a semiskilled or unskilled workforce. In summary, there is a lack of environmentally responsible building materials that in their assembly use advanced technology that is inclusive.

SUMMARY OF THE INVENTION

In one aspect, the present invention proposes a building system which defines the creation of a building material that can be manufactured by high or medium technology and that can utilise either high or low skilled labour. Furthermore, the building material is suited to off-site and on-site assembly by either automated processes or without the use of rare skills. The present invention also provided a means by which small construction firms can build without being dependent on bricklayers, carpenter/joiners and plasters. In this context, a building system may be defined as a set of interconnected or interrelated parts forming a complex whole, used in constructing something from parts ('system' and 'build', in: 'Chambers Concise Dictionary', Chambers-Harrap, Edinburgh, 2004)

In accordance with a first aspect of the invention there is provided a building system in which one or more planar member, having a planar surface and edges which define the shape of the planar member, is used to form system parts which form at least part of one or more system components, the system comprising the steps of:

determining the system components to be created and which system parts are required to make the system component, for each system part, sub-dividing the planar member appropriately to create sections and assembling the sub-divided sections into the system part; to creating the system component using system parts.

Preferably, the planar member is a flat panel or sheet.

Preferably, the planar member comprises a wood containing product.

Preferably, the planar member is sub divided by cutting the sections into strips of a predetermined width.

Preferably, the system part is a tube having a square or rectangular cross section which is formed by fixing together the sections of a predetermined width.

Preferably, one or more inside surface of the tube is reinforced with one or more additional sections.

Preferably, the one or more additional sections are made from a secondary material such as off-cuts and selected waste from a planar member.

Preferably, the tube is cut into lengths to form one or more shorter tube that acts as a spacer.

Preferably, the spacer is secured between planar surfaces of adjacent planar members to separate the planar members.

Preferably, the length, width and height of the spacer is determined by the sizes of the sections fixed together and the length to which the completed tube is cut.

Preferably, the orientation of the spacers may be alternated to increase the resistance of tubular spacers to strengthen against the effects of mechanical stress and strain.

Preferably, the system component is a non-solid panel or block wherein a first and second flat panel are positioned to face one another and a plurality of spacers connected to opposing faces of the flat panels, wherein the spacers separate and connect said planar members.

Preferably, the non-solid panel comprises peripheral spacers which are placed at a distance from the edges of the flat panels that is less than the distance between the spacers.

Preferably, at least two adjacent spacers are positioned near the edges of the flat panels such that the gap between the spacers is sized to secure a permanent or removable connector between the spacers.

Preferably, the system component is a connector sized to securely fit in gaps between spacers in a panel or block wherein the tube is cut into lengths to form shorter tubes that form connectors.

Preferably, the system component is an end piece or panel edge sized to fit in the open edge of a panel or block.

Preferably, the end piece or panel edge comprises the tube which is cut into lengths to form a shorter tube.

Preferably, the system component is a rectangular beam made from a non-solid panel to which the end piece or panel edge are structurally added.

Preferably, the beam is one of the following shaped beams: I-shaped beams, L-shaped beams, T-shaped beams, U-shaped beams, Z-shaped beams, and other beams which have been created by structurally adding to rectangular beams edge pieces, connectors, other rectangular beams and other components in accordance with the system of the present invention.

Preferably, the planar member comprises plywood or other panel products.

Preferably, the planar member comprises particle board.

Preferably, the particle board comprises, the particle board is Oriented Strand Board, OSB.

Preferably, the components are packed for lifting and transport by means of straps fed through supporting rectangular tubes so that they tie the building materials to the tubes.

Preferably, a dedicated set of machine operations is used to manufacture the components in accordance with the system of the present invention.

In accordance with a second aspect of the invention there is provided a non-solid panel made in accordance with the building system of the present invention.

Preferably, the non-solid panel comprises planar members which are positioned to face one another and a plurality of spacers connected to opposing faces of the planar members, wherein the spacers separate and connect said planar members.

Preferably, the non-solid panel comprises peripheral spacers which are placed at a distance from the edges of the planar members that is less than the distance between the spacers.

Preferably, at least two adjacent spacers are positioned near the edges of the planar members such that the gap between the spacers is sized to secure a permanent or removable connector between the spacers.

In accordance with a third aspect of the invention, there is provided, a connector made in accordance with the building system of the first aspect of the present invention.

Preferably, the connecter being sized to securely fit in gaps between spacers in a panel or block wherein the tube is cut into lengths to form shorter tubes that form connectors.

In accordance with a fourth aspect of the invention, there is provided, an end piece made in accordance with the building system of the first aspect of the present invention.

Preferably, the end piece or panel edge sized to fit in the open edge of a panel or block.

In accordance with a fifth aspect of the invention, there is provided, an end piece made in accordance with the building system of the first aspect of the present invention.

In accordance with a sixth aspect of the invention, there is provided, a beam made in accordance with the building system of the first aspect of the present invention.

In one aspect, there is provided a building material comprising system parts that are made from a material forming a single plane, and according to a system that defines those system parts and the way in which these are three dimensionally and permanently composed and made from the material forming a single plane.

The method of manufacture of the tubes, panels and other building elements uses two manufacturing operations, which may be located in the same or in different geographic locations. Each may be tuned to low, medium or advanced levels of technology and corresponding levels of employment of unskilled, semiskilled and skilled labour, compactness of operation, quality control and capital investment.

Despite these differences, the processes are tandem operations and remain so through corresponding updates. In both processes, components are fixed to each other by means of gluing, nailing, stapling, screwing or the like. Preferably, gluing is supplemented by nailing, stapling, screwing or the like so as to avoid the need for hydraulic or similar pressing, and in order to reduce the risk of sudden glue joint failure. Fixings within manufactured tubes, panels and other building elements are treated as permanent. Assemblies of building elements may be screwed, bolted or the like to enable the structure to be dismounted and the elements to be re-used in either re-assemblies or in new assemblies.

In the present invention, modular building elements comprising of entire or parts of panels, panel connectors, panel edges and building elements that are composites of such parts are assembled to form floors, walls, partitions, ceilings and roofs of domestic-scale structures and the like. It will be appreciated that where screws, bolts or other removable fixings are used in the assembly the building material can be disassembled and re-used.

The panels, panel connectors, panel edges and/or the further elements made from these may be integrally or separately insulated as required. It will be appreciated that internal and external surfaces of structures may be clad or finished to suit preferences.

Preferably, the further elements are cut and assembled by an automated process from the panels, panel connectors and panel edges on the basis of required type and quantities. In the process, types, dimensions and quantities of all elements are calculated from the drawings of the building to be built. Factors in these calculations include the methods of transport and construction. Where the latter is aided by mechanical equipment the capabilities of the equipment are taken into account and where the structure is to be constructed by hand the dimensions of the building elements are limited by human scale and its weight determined by the lifting, carrying and placing capacity of one or more persons.

In another aspect of the invention there is provided a building material and system comprising: Modular panels comprising two planar, members or skins that are separated by spacers with their centres placed in an orthogonal array and with opposing and adjacent sides that respectively are morphologically equal and unequal and orthogonally opposed to those of their nearest other spacers, the panels being able to be subdivided into modular subpanels with one or more spacers and having perimeters that allow insertion between the panel skins of enclosing components or panel edges and of jointing components or panel connectors so that after insertion the external faces of the panel edges and the centre lines of the connectors coincide with the module lines of the original panel.

The panel connectors and panel edges of claim 1 comprising of strips of one or more planar members of widths W1 and W2 and nominal thickness T, assembled so that they form components that are rectangular tubes of height W1 and widths of resp. W1 plus 2T and W2 plus 2T, where W1 plus 2T nominally equals 0.5M and W2 plus 2T nominally equals 0.25M, M being the module of claim 1.

The spacers of claim 1 comprising lengths of the tubes of width W1 or W2 and of length 0.5 M. The manufacture operation of the modular panels of claim 1, the panel connectors and the panel edges of claim 2 and the panel spacers.

The manufacture operation and pre-assembly of modular building elements such as portable sub-panels or blocks, beams, columns, lintels, cassettes and the like from the modular panels, panel connectors and panel spacers.

BRIEF DESCRIPTION OF THE DRAWINGS

The present invention will now be described by way of example only with reference to the accompanying illustrations, in which.

DETAILED DESCRIPTION OF THE DRAWINGS

In one or more embodiment of the present invention as described below, a building system is created where system parts are created from a flat panel or sheet material and system components are created from system parts. A system part may be defined as a basic element of the system such as a tube or spacer; it is made from subdivided sections that have been removed from the flat panel or sheet material.

A system component may be defined as a composition of system-parts that collectively form a pre-fabricated part of a building or structure such as a non-solid panel, block or beam. A tube is a hollow square or rectangular cross section system part.

Figure 1:
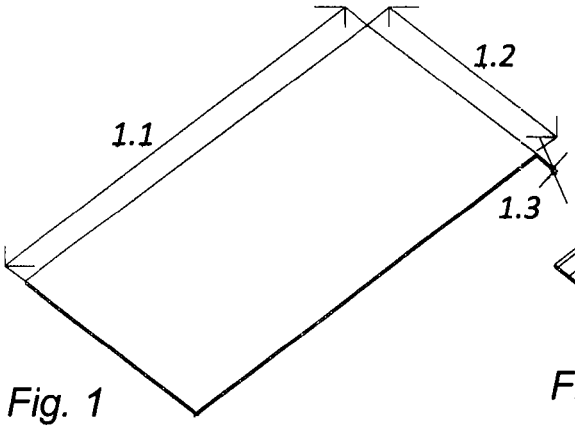
FIG. 1 illustrates a sheet of semi material of length L, width W and thickness T.

FIG. 1 illustrates a planar member or sheet of semi material length L, width W and thickness T. L and W are determined by computer controlled cutting, and T varies due to manufacturing tolerances. L, W and T are selected on the basis of availability and technical and commercial criteria. The sheets are used for forming the panel skins and to provide the material for cutting the sections or strips used in forming the tubes. In FIG. 1, 1.1 illustrates length L; 1.2 illustrates width W; and 1.3 illustrates variable thickness T.

Figure 2:
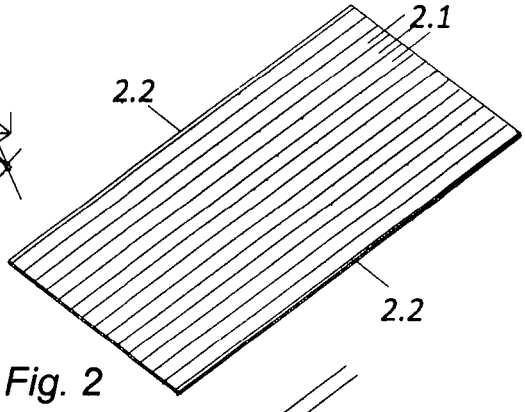
FIG. 2, 2.1 illustrates strips of width W1; and 2.2 illustrates offcuts of variable width Wx.

FIG. 2 illustrates a sheet cut in strips of widths W1, leaving irregular offcut Wx. W1 is used to form the webs of rectangular tubes. In FIG. 2, 2.1 illustrates strips of width W1; and 2.2 illustrates offcuts of variable width Wx.

Figure 3:
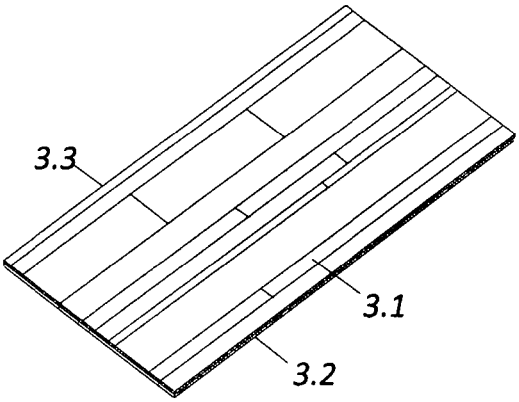
FIG. 3 illustrates how offcuts of width Wx are placed and fixed to a sheet, forming a sheet that is nominally 2T thick.

FIG. 3 illustrates how offcuts Wx are placed and fixed to a planar member or sheet, forming a new sheet that is nominally 2T thick with variations due to the different manufacturing tolerances in the thickness of the various strips. The offcuts are supplemented by other offcuts and second grade material to form the irregular top of a double sheet, which may show small gaps in places were offcuts and the like do not entirely match. The resulting irregular sheet, which takes care of offcuts and other secondary material that would otherwise be wasted, is now cut into strips of widths W1 and W2. These strips form the flanges of the tubes, in which they are placed so that the irregular surfaces are on the inside of the tube, whilst the greater thickness of the flanges provides increased stability to the tube. Further, in assembling panel-based elements, the increased thickness of the flanges of the tube provides fixing grounds for nails, staples, screws and the like.

FIG. 3, 3.1 illustrates offcuts and second grade material; 3.2 illustrates the sheet to which these are fixed; and 3.3 illustrates the resulting irregular surface prior to cutting the double thickness sheet in strips of widths W1 and W2.

Figure 4:
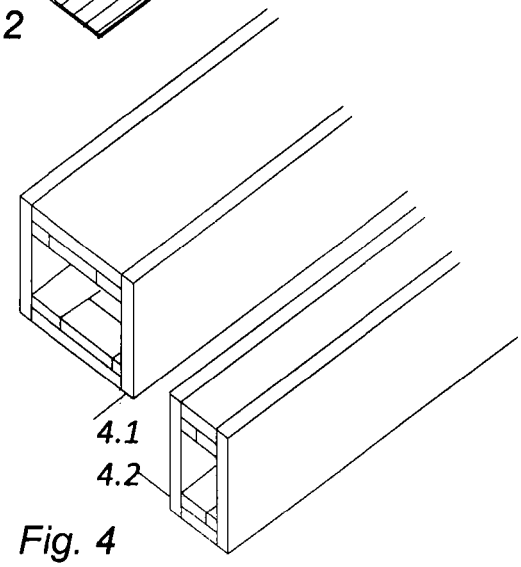
FIG. 4 illustrates the strips of FIGS. 2 and 3 fixed in position by gluing or the like to form wider and narrower rectangular tubes.

FIG. 4 illustrates the strips of FIGS. 2 and 3 assembled by gluing or the like to form the rectangular tubes used in manufacturing spacers, panel connectors and panel edges. In FIG. 4, 4.1 illustrates a tube of width D forming a connector; and 4.2 illustrates a tube of width ½D, forming a panel edge.

In this and other examples of the present invention, a connector is a length of tube typically used to connect the semi-solid panels in the same plane A panel edge is a length of tube that has less width than a connector, typically used to close the open ends of the semi-solid panels, and to connect semi-solid panels at right angles to one another.

Figure 5:
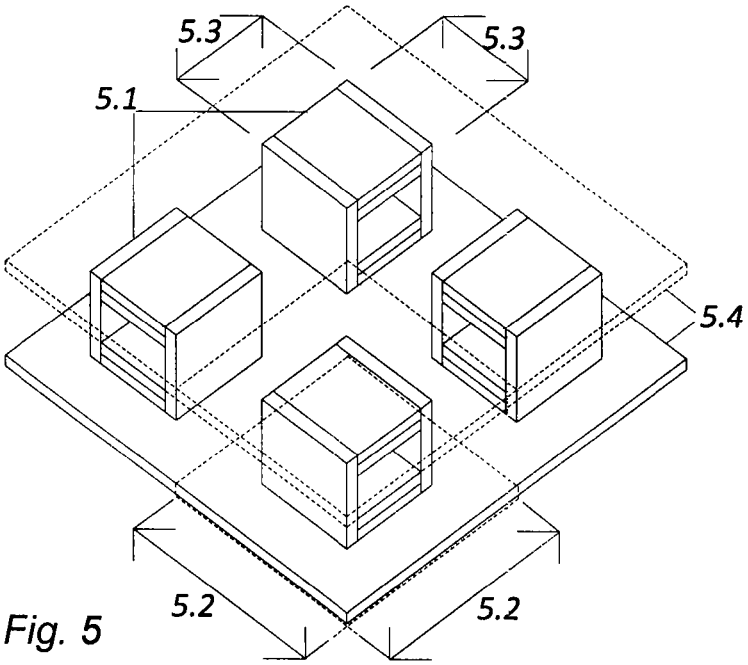
FIG. 5 illustrates how the wider tubes are cut into short lengths to form spacers that separate the two skins of the building material.

FIG. 5 illustrates how tubes are cut into short lengths to form spacers that separate the two skins of the building material.

Preferably, the spacers are placed at regular centres forming orthogonal rows and columns of spacers. The distances between the centres equal the modules of the building material. Preferably, the spacers are placed so that in each row and column they alternate in direction. In the illustration, the module in both rows and columns is twice the depth D of the panel and twice the width of the spacer tube.

FIG. 5, 5.1 illustrates these spacers arranged in array; 5.2 illustrates the system module M; 5.3 illustrates that in this case the length of the spacer is ½M and equal to its width; and 5.4 illustrates the panel skins that are attached to the spacers.

Figure 6:
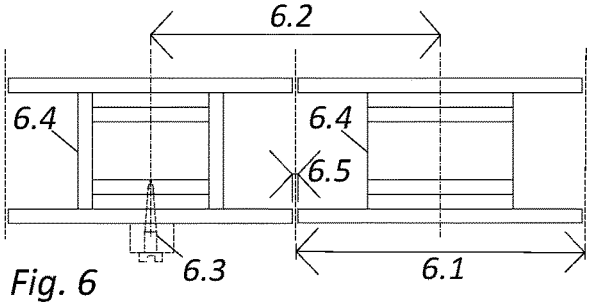
FIG. 6 illustrates a section through a panel that in this case is two modules wide and has a panel depth that equals the width of the spacers.

FIG. 6 illustrates a section through a panel that in this case is two modules wide and with a panel depth that equals the width of the spacers. The figure illustrates that at and around the centres of the spacers the panel thickness is greater than between spacers. Further, FIG. 6 illustrates that by cutting along equidistant lines between spacer centres, modular sub-panels or blocks are formed that are one module wide but that in principle may be of any modular proportion and any size smaller than the panel from which it is cut, and that the blocks have a modular dimension in both orthogonal directions but in each case minus the width of the kerf.

In FIG. 6, 6.1 illustrates module dimensions; 6.2 the same distance between centres of spacers, 6.3 illustrates a fixing to the fixing ground provided in and around the centres of the spacers; 6.4 illustrates that two adjacent tubular spacers change 90° in their orientation, and 6.5 the kerf arising from subdividing the element.

In the preferred and illustrated case, spacers are square in plan (ie, their length equals their width, not their height). For instance, where a panel or blocks has a depth of 100 mm and the module is 200 mm, the tube is 100 mm wide but the height of the tube is 100 mm minus 2× the thickness of the skin (planar member). Where the sides of the tube are the same as the thickness of the skin, it is the width of the double thickness strip that forms the top and bottom of tube that has the same dimension as the height of the tube (see FIG. 6). Typically tubes form respectively (1) the spacers, and the panel connectors; (2) the panel edges, which in illustration 6 would be formed by tubes that are half the width of the panel connectors.

Please note that this narrower tube can also be used to form spacers, which in that case would be not square but elongated in plan. This layout has the advantage of being more economical in the use of material (due to a narrower width of the double strips). Spacers that alternate in orientation can be narrow such as strips of timber or plastic or the like placed on edge, perhaps for a product that is much smaller in scale. Similarly, strips of the planer member or skin, or projections integrally formed as part of one or both of the skims, or just strips of a solid material (eg, wood), can be used to form panels, including panels that have very shallow depth In each case, the alternating orientation of the spacers reduces the amount of material in the spacers.

In summary, alternating orientation:

Increases the resistance of tubular spacers against the effects of wracking (twisting, warping; as occurs in an earthquake). It is noted that for the convenience of correctly locating and fixing connectors and edges to sides of panels/blocks that are 1-3 modules wide, the tubular spacers are preferably square in plan.

May reduce material used in forming spacers, irrespective of the shape of the cross-section of the spacers (such as tubular, solid, I-shape, etc.).

Figure 7:
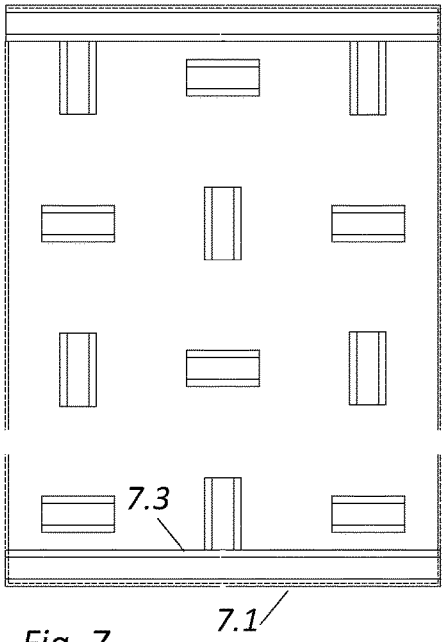
FIG. 7 illustrates a similar panel that has spacers that are cut from the narrower tubes.

FIG. 7 illustrates a section through a panel that is three modules wide and in which the spacers are cut from the narrower tube. In FIG. 7, 7.1 illustrates a case where the positioning of a panel edge or connector is stable and 7.3 a case where this is not so without additional measures.

Figure 8:
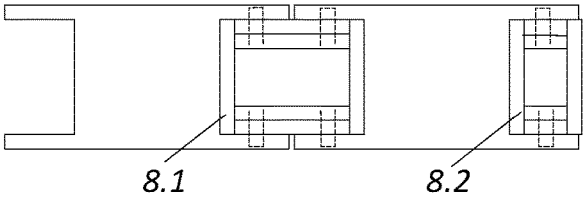
FIG. 8 illustrates how panels and hence panel-derived elements are connected and reinforced by inserting and fixing panel connectors and panel edges.

FIG. 8 illustrates how panels and hence panel-derived elements are connected and reinforced by inserting and fixing panel connectors. Further, the figure illustrates how the edge of the panel is completed and reinforced by inserting and fixing a panel edge. The section illustrates that the location of the insertions is determined by the spacers so that elements retain their modular station irrespective of the width of the kerf. Where the work has to meet non-modular work, or in the case of module creep, the panel edges can be adjusted; in the case where a gap needs to be filled between new modular and existing work, the builder places a panel connector into the edge of new work, plants a panel edge on the face of existing work and fixes lining to these. In FIG. 8, 8.1 illustrates a panel connector and its fixings and 8.2 a panel edge and its fixings. It will be appreciated that, where an expansion joint is required, this can be achieved by means of a slip joint.

Figure 9:
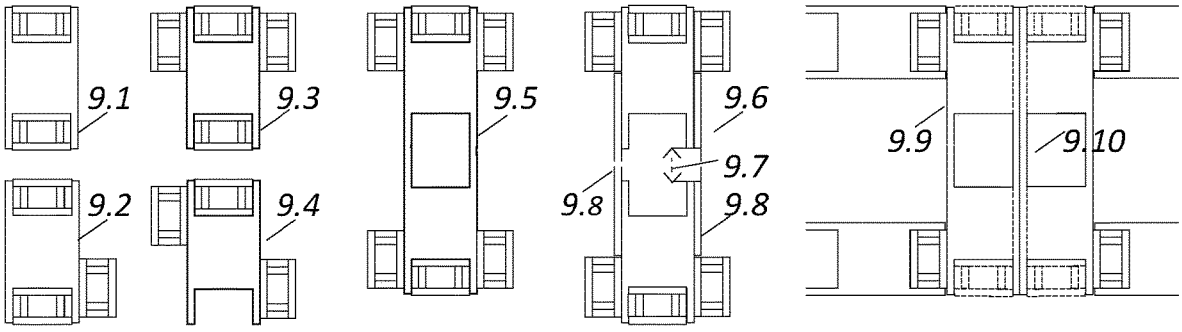
FIG. 9 illustrates how sub-panels or blocks of various kinds are combined with panel edges to form rectangular beams, I-beams, L-beams, T-beams, U-beams, Z-beams.

FIG. 9 illustrates how sub-panels or blocks of various kinds are combined with panel edges to form beams. A beam is a horizontal, vertical or sloping structural component for supporting a part of a building or structure.

It will be appreciated that other combinations at various scales and proportions can be fabricated to suit a wide range of scales and circumstance. In FIG. 9, 9.1 illustrates a rectangular beam; 9.2 an L-beam; 9.3 a T beam; 9.4 a Z-beam and 9.5 an I beam. 9.6 illustrates a combination of two T-beams separated by triangular gap 9.7 and connected plates 9.8 that bridge the gap, in this case forming a beam with a sloping upper surface designed to form a low-pitch roof; 9.9 illustrates 25 that sides of parts that in that in this case form sides of cassettes can be internally connected. In 9.10, bolts or the like are placed in locations inside the U-beams.

Figure 10:
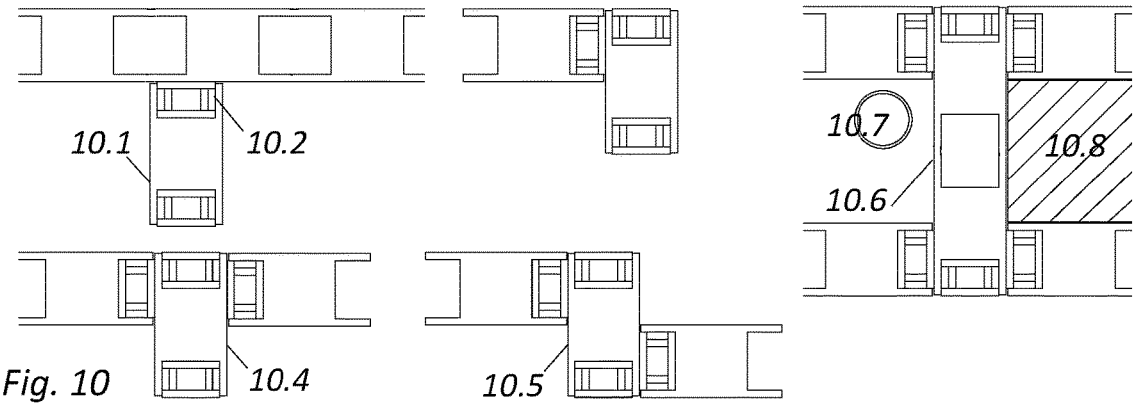
FIG. 10 illustrates a cross section through the double panels of the floor, walls and ceiling of a domestic scale structure wherein the double panels have intermediate insulation and are assembled together with the supporting l-beams in the manner of FIGS. 8 and 9.

The fixings may be inserted through temporary or permanent omission of panel edges or connectors or parts thereof FIG. 10 illustrates various beams supporting plain panels in single and double combinations for forming floors, walls, ceilings and the like. In FIG. 10, 10.1 illustrates a plain rectangular beam supporting a panel. Typically, panel edge 10.2 is fixed to the panel, which is then slotted into the open beam and fixed on both sides. illustrates an L-beam and panel, 10.4 a T-beam and two panels, 10.5 a Z-beam and two panels, and 10.6 an I beam and four panels. Typically, this construction is used to form cavities that may accommodate building services 10.7 or insulation 10.8.

Figure 11:
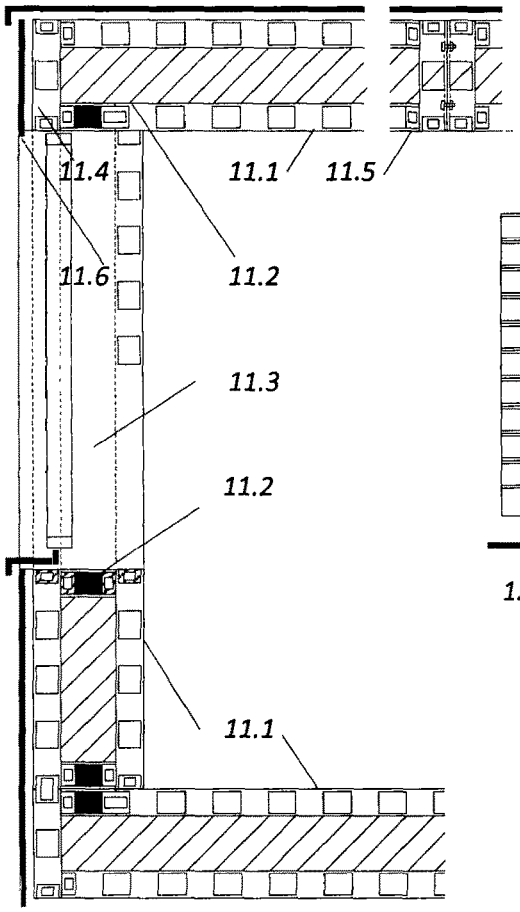
FIG. 11 illustrates a cross section through the internally insulated I-beams of the structure of FIG. 10.

FIG. 11 illustrates a section through a domestic-scale structure that is constructed in the manner of FIG. 9.10. In FIG. 11, 11.1 illustrates a section through the double panel construction forming a floor, wall and ceiling, 11.2 illustrates insulation and higher density insulation to cassette end closers that are formed of skins and rectangular tubes; 11.3 an opening; the span across the opening being supported by beam 11.4. 11.5 illustrates a cross section through parts of two adjacent cassettes and their internal connection in the manner of 9.9. Externally, 11.6 illustrates a ventilated rain screen cladding.

Figure 12:
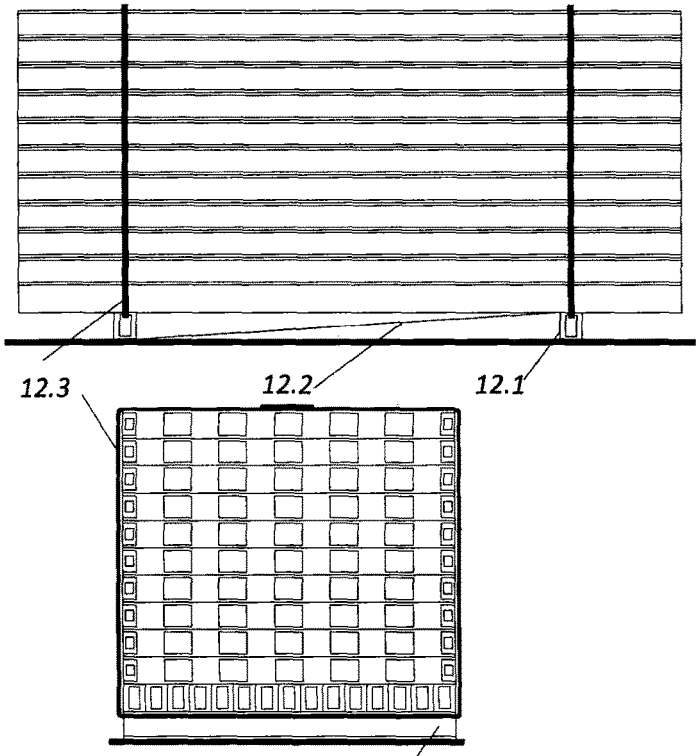
FIG. 12 illustrates U-shaped frames in which manufactured panels, connectors, edges and the like are placed for transport.

FIG. 12 illustrates rectangular tubes upon which manufactured panels, connectors, edges and the like are placed for transport. In FIG. 12, 12.1 illustrates the two or more tubes; 12.2 illustrates the space for inserting the forks of forklifts and the like; 12.3 illustrates a strap that ties the stacked goods to the tubes. To protect the edges of panels, and to enable half panels and the like to be shipped, long lengths of edges are inserted into the open sides of the panels.

For smaller lots, panels, panel connectors and panel edges may be combined in one stack, as illustrated.

Figure 13:
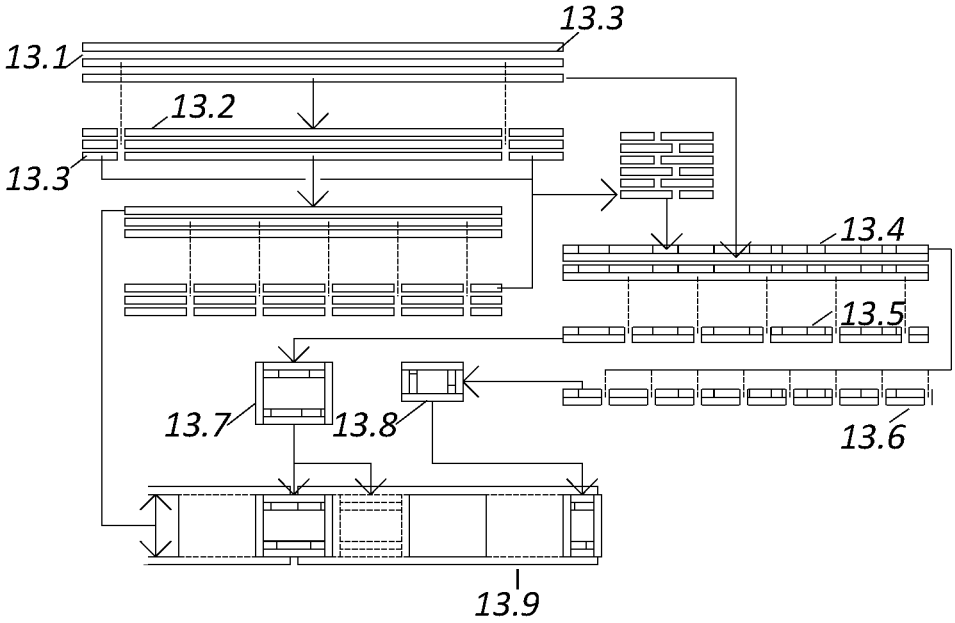
FIG. 13 illustrates Operation I.

FIG. 13 illustrates manufacturing Operation I. In its high technology version, the operation is performed by an automated compact set of machinery that is preferably mobile. Operation I receives untrimmed sheets, trims these, keeps the trimmings for later use, cuts some of the trimmed sheets into strips of widths A, keeps remnants for later use, takes other sheets as base-sheets for receiving trimmings and remnants to form double sheets with one irregular side, and cuts these double sheets into widths A and B. It then combines strips of various widths to form wider and narrower tubes, cuts selected tubes to form spacers, and from these spacers and trimmed sheets forms panels. Further, the Operation packs the manufactured panels, tubes and edges into transportable packs that are ready for shipping to Machine Operation II. Operations I and II may be at different levels of technology and in different locations.

In FIG. 13, 13.1 illustrates a stack of untrimmed sheets and 13.2 a stack of trimmed sheets; 13.3 illustrates a set of offcuts and other remnants; 13.4 illustrates the offcuts and other remnants fixed to a sheet to form a double sheet; 13.5 illustrates double sheet cut into strips of different widths; 13.6 illustrates a single sheet cut into strips; 13.7 illustrates a wider tube formed from strips 13.5 and 13.6; 13.8 illustrates a similar tube but of lesser width; 13.9 illustrates a panels comprising of tube 13.7 cut into spacer lengths, with skins 13.2 and with tube 13.8 enclosing and reinforcing the edge of the panel.

Figure 14:
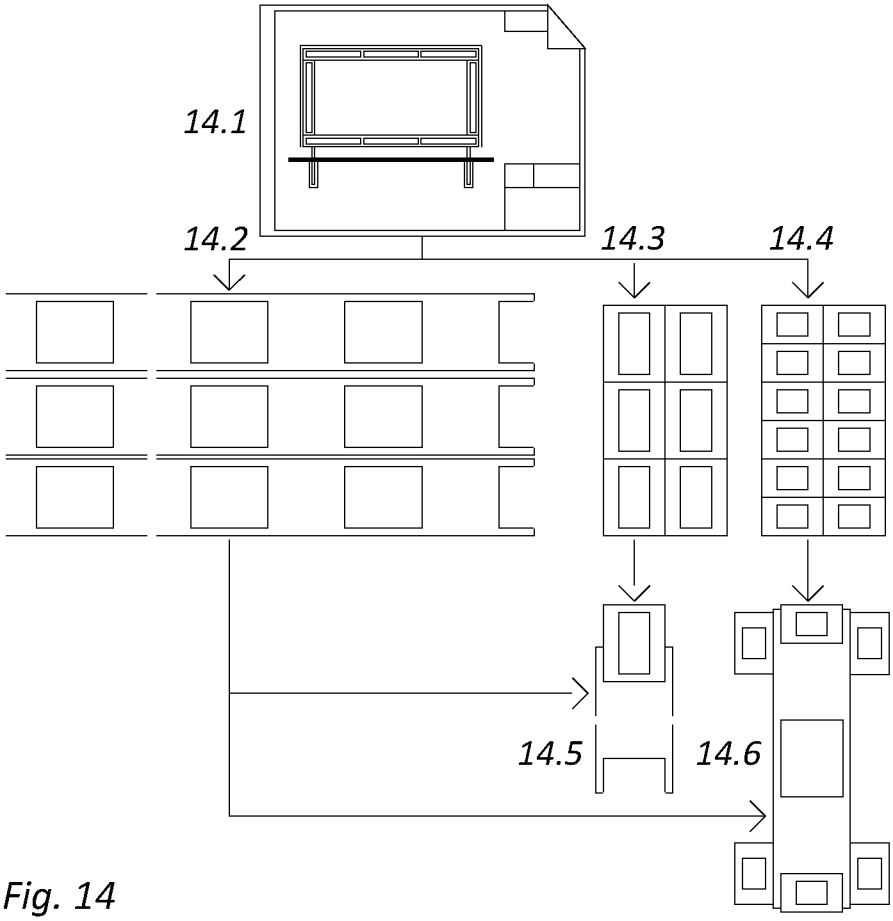
FIG. 14 illustrates Operation II.

FIG. 14 illustrates sub-assembly Operation II. In its high technology version, the operation is performed by an automated compact machine that is preferably mobile. Operation II receives panels, connectors and edges, cuts these and combines the cuttings to form blocks, beams and other building elements. The types, sizes and numbers of these elements are listed in instructions that are derived from the design of the structure that is to be assembled from the elements. Further, the operation packs the manufactured elements according to instructions that are derived from selected types of packing parameters and offsite/onsite construction. In FIG. 14, 14.1 illustrates the instructions relating to the design of the structure; 14.2 illustrates a supply of panels; 14.3 illustrates a supply of wider and 14.4 a s supply of narrower tubes; 14.5 illustrates a typical panel, in this case with a panel connector pre-attached; and 14.6 a typical composite building element.

Improvements and modifications may be incorporated herein without deviating from the scope of the invention.

The invention claimed is:

1. A building process in which one or more planar member, having a planar surface and edges which define the shape of the planar member, the planar member being used to form system parts which foim at least part of one or more system components, the process comprising the steps of:

determining the system components to be created and which system parts are required to make the system component, for each system part, sub-dividing the planar member by cutting the planar member into strips of a predetermined width to create sections and assembling the sub-divided sections into the system part to creating the system component using system parts wherein at least one system part is a tube having a square or rectangular cross section which is formed by fixing together the sections of a predetermined width, at least one tube is cut into lengths to form one or more shorter tube that acts as a spacer and wherein, the spacer is secured between planar surfaces of adjacent planar members to separate the planar members.

2. A building process as claimed in claim 1, wherein the planar member is a flat panel or sheet.

3. A building process as claimed in claim 1, wherein the planar member comprises a wood containing product.

4. A building process as claimed in claim 1, wherein one or more inside surface of the tube is reinforced with one or more additional sections.

5. A building process as claimed in claim 1, wherein the one or more additional sections are made from a secondary material off-cuts or selected waste from a planar member.

6. A building process as claimed in claim 1, wherein the length, width and height of the spacer is determined by the sizes of the sections fixed together and the length to which the completed tube is cut.

7. A building process as claimed in claim 1, wherein the orientation of the spacers may be alternated to increase the resistance of tubular spacers to strengthen against the effects of mechanical stress and strain.

8. A building process as claimed in claim 1, wherein the process component is a non-solid panel or block wherein a first and second flat panel are positioned to face one another and a plurality of spacers connected to opposing faces of the flat panels, wherein the spacers separate and connect said planar members.

9. A building process as claimed in claim 8, wherein the non-solid panel comprises peripheral spacers which are placed at a distance from the edges of the flat panels that is less than the distance between the spacers.

10. A building process as claimed in claim 8, wherein at least two adjacent spacers are positioned near the edges of the flat panels such that the gap between the spacers is sized to secure a permanent or removable connector between the spacers.

11. A building process as claimed in claim 1, wherein the process component is a connector sized to securely fit in gaps between spacers in a panel or block wherein the tube is cut into lengths to Rhin shorter tubes that form connectors.

12. A building process as claimed in claim 1, wherein the process component is an end piece or panel edge sized to fit in the open edge of a panel or block.

13. A building process as claimed in claim 12, wherein the end piece or panel edge comprises the tube which is cut into lengths to form a shorter tube.

14. A building process as claimed in claim 8, wherein the system component is a rectangular beam made from a non-solid panel to which the end piece or panel edge are structurally added.

15. A building process as claimed in claim 14, wherein the beam is one of the following shaped beams: I-shaped beams, L-shaped beams, T-shaped beams, U-shaped beams, Z-shaped beams, which have been created by structurally adding to rectangular beams edge pieces, connectors, other rectangular beams and other components made in accordance with the process.

16. A building process as claimed in claim 1, wherein the planar member comprises plywood or other panel products.

17. A building process as claimed in claim 16, wherein the planar member comprises particle board.

18. A building process as claimed in claim 16, wherein the particle board comprises, the particle board is Oriented Strand Board, OSB.

19. A building process as claimed in claim 1, wherein the components are packed for lifting and transport by means of straps fed through supporting rectangular tubes so that they tie the building materials to the tubes.

20. A building process as claimed in claim 1, wherein, a dedicated set of machine operations is used to manufacture the components.

* * * * *